US008191185B2

(12) United States Patent
Tsai

(10) Patent No.: US 8,191,185 B2
(45) Date of Patent: Jun. 5, 2012

(54) HOLDER DEVICE FOR SHOWER HEAD AND NOZZLE

(76) Inventor: Pi Kuang Tsai, Taichung (TW)

( * ) Notice: Subject to any disclaimer, the term of this patent is extended or adjusted under 35 U.S.C. 154(b) by 909 days.

(21) Appl. No.: 12/287,370

(22) Filed: Oct. 8, 2008

(65) Prior Publication Data

US 2009/0265848 A1 Oct. 29, 2009

Related U.S. Application Data

(63) Continuation-in-part of application No. 12/150,471, filed on Apr. 28, 2008, now abandoned.

(51) Int. Cl.
*A47K 3/022* (2006.01)

(52) U.S. Cl. ..... 4/601; 239/444; 239/445; 4/573.1; 4/615; 4/568; 4/570

(58) Field of Classification Search ..... 4/570, 573.1, 4/601, 568, 569, 559, 615, 144.1–144.4; 239/444, 445
See application file for complete search history.

(56) References Cited

U.S. PATENT DOCUMENTS

| | | | | |
|---|---|---|---|---|
| 6,829,790 | B2 * | 12/2004 | Petrovic et al. | 4/601 |
| 6,973,682 | B2 * | 12/2005 | Zhadanov | 4/601 |
| 7,043,776 | B1 * | 5/2006 | Wu | 4/601 |
| 7,197,776 | B2 | 4/2007 | Tsai | 4/615 |
| 7,299,510 | B2 | 11/2007 | Tsai | 4/601 |
| 2006/0230520 | A1 * | 10/2006 | Tsai | 4/567 |
| 2006/0242759 | A1 * | 11/2006 | Tsai | 4/605 |

* cited by examiner

*Primary Examiner* — Gregory Huson
*Assistant Examiner* — Lauren Heitzer
(74) *Attorney, Agent, or Firm* — Charles E. Baxley

(57) ABSTRACT

A holder device may be attached to a water outlet tube which is extended from a wall, without drilling holes in the wall, and includes a housing having an inlet attached to the water outlet tube, and two or more outlet ports for coupling to a shower head and a sprayer nozzle, a base having a spring-biased latch for clamping the pipe to the base, a seat slidably attached onto the pipe for adjustably and removeably supporting the sprayer nozzle. The housing includes a casing having a chamber for receiving a valve stem, and a spring-biased valve member received in the valve stem to control the water to flow out through the outlet ports of the housing, and a knob secured to the valve stem to rotate the valve stem relative to the casing and the housing.

6 Claims, 11 Drawing Sheets

HOLDER DEVICE FOR SHOWER HEAD AND NOZZLE

The present invention is a continuation-in-part of U.S. patent application Ser. No. 12/150,471, filed 28 Apr. 2008, now abandoned.

BACKGROUND OF THE INVENTION

1. Field of the Invention

The present invention relates to a holder device and/or a control device, and more particularly to a holder and control device for supporting shower heads and shower nozzles, and for controlling the water to flow out through either or both of the shower heads and the nozzles.

2. Description of the Prior Art

Typical holder devices for supporting shower nozzles or other appliances comprise a bracket attached or secured to upper portions of supporting surfaces or walls or the like with fasteners. One or more holes should be drilled into the supporting surfaces or walls or the like with drilling machines or tools, for allowing the fasteners to be threaded into the supporting surfaces or walls or the like.

The present applicant has developed a holder device for adjustably supporting shower nozzles or the like, and for readily attaching to the supporting the surfaces or walls or the like without drilling holes in the supporting surfaces or walls or the like, and the holder device has been filed and issued as U.S. Pat. No. 7,197,776 to Tsai.

However, the holder device may only be used for adjustably supporting shower nozzles, but has no shower heads available such that the user may use the shower nozzles only.

U.S. Pat. No. 7,299,510 to Tsai discloses another holder and control device for supporting shower heads and shower or sprayer nozzles, and for controlling the water to flow out through either or both of the shower heads and the shower or sprayer nozzles.

However, the shower or sprayer nozzle attaching device is supported at a higher position to the water outlet tube and may not be easily fetched or obtained by the users, particularly the children and the like.

The present invention has arisen to mitigate and/or obviate the afore-described disadvantages of the conventional holder devices for supporting the shower heads and/or the shower or sprayer nozzles.

SUMMARY OF THE INVENTION

The primary objective of the present invention is to provide a holder device directly attached to the water outlet tube that is provided and extended from the supporting surfaces or walls, for supporting shower heads and/or shower nozzles and the like.

The other objective of the present invention is to provide a holder device for readily attaching to the supporting surfaces or walls or the like without drilling holes in the supporting surfaces or walls or the like.

The further objective of the present invention is to provide a holder device for controlling the water to flow out through either or both of the shower heads and the nozzles.

The still further objective of the present invention is to provide a holder device for easily and adjustably supporting shower nozzles or the like.

In accordance with one aspect of the invention, there is provided a holder device for attaching to a water outlet tube which is extended from a supporting surface, the holder device comprising a housing including an inlet for attaching to the water outlet tube and for receiving a water from the water outlet tube, the housing including a first outlet port and at least one second outlet port, and including a casing received in the housing, the casing including a chamber formed therein and communicating with the inlet and the first outlet port and the second outlet port of the housing, the housing including two valve seats formed in the casing and communicating with the first outlet port and the second outlet port of the housing respectively, a pipe including an upper portion coupled to the first outlet port of the housing for receiving the water from the housing, and including a lower portion and an intermediate portion, a sprayer nozzle coupled to the lower portion of the pipe for receiving the water from the pipe, a sprayer device attached to the second outlet port of the housing, a base including a conduit extended therefrom and having a bore formed in the conduit, and an orifice formed through the conduit and communicating with the bore of the conduit for slidably receiving the pipe, a spring-biased latch slidably received in the bore of the conduit and having an opening formed in the latch for slidably receiving the pipe, a seat slidably attached onto the pipe and including a bracket extended from the seat and having an engaging hole formed in the bracket for removeably supporting the sprayer nozzle, the seat including a bore formed therein, and an aperture formed through the seat and communicating with the bore of the seat for slidably receiving the intermediate portion of the pipe, a spring-biased catch slidably received in the bore of the seat and having an opening formed in the catch for slidably receiving the intermediate portion of the pipe and for biasing the catch to the pipe and for adjustably securing the seat to the pipe, a valve stem rotatably attached in the chamber of the casing, and having a passage formed in the valve stem for communicating the inlet of the housing with the first outlet port and the second outlet port of the housing, to allow the water to selectively flow out through the first outlet port and the second outlet port of the housing, the valve stem including a compartment formed therein, a valve member received in the compartment of the valve stem to engage with either of the valve seats of the housing, and to control the water to flow out through the first outlet port and the second outlet port of the housing, and a knob secured to the valve stem to rotate the valve stem relative to the casing and the housing.

The housing includes a spring-biased projection disposed therein and engageable with the knob to position the knob to the housing at selected positions.

The knob includes a barrel extended therefrom, and at least one flap extended outwardly from the knob for allowing the valve stem to be easily rotated relative to the housing with the knob.

A second bracket is further provided and attached to the housing and includes an engaging hole formed in the second bracket for removeably supporting the sprayer nozzle.

The second bracket is attached to the housing with a plate, an insert and a fastener. The sprayer device may be selected from any kind of shower heads or the like.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
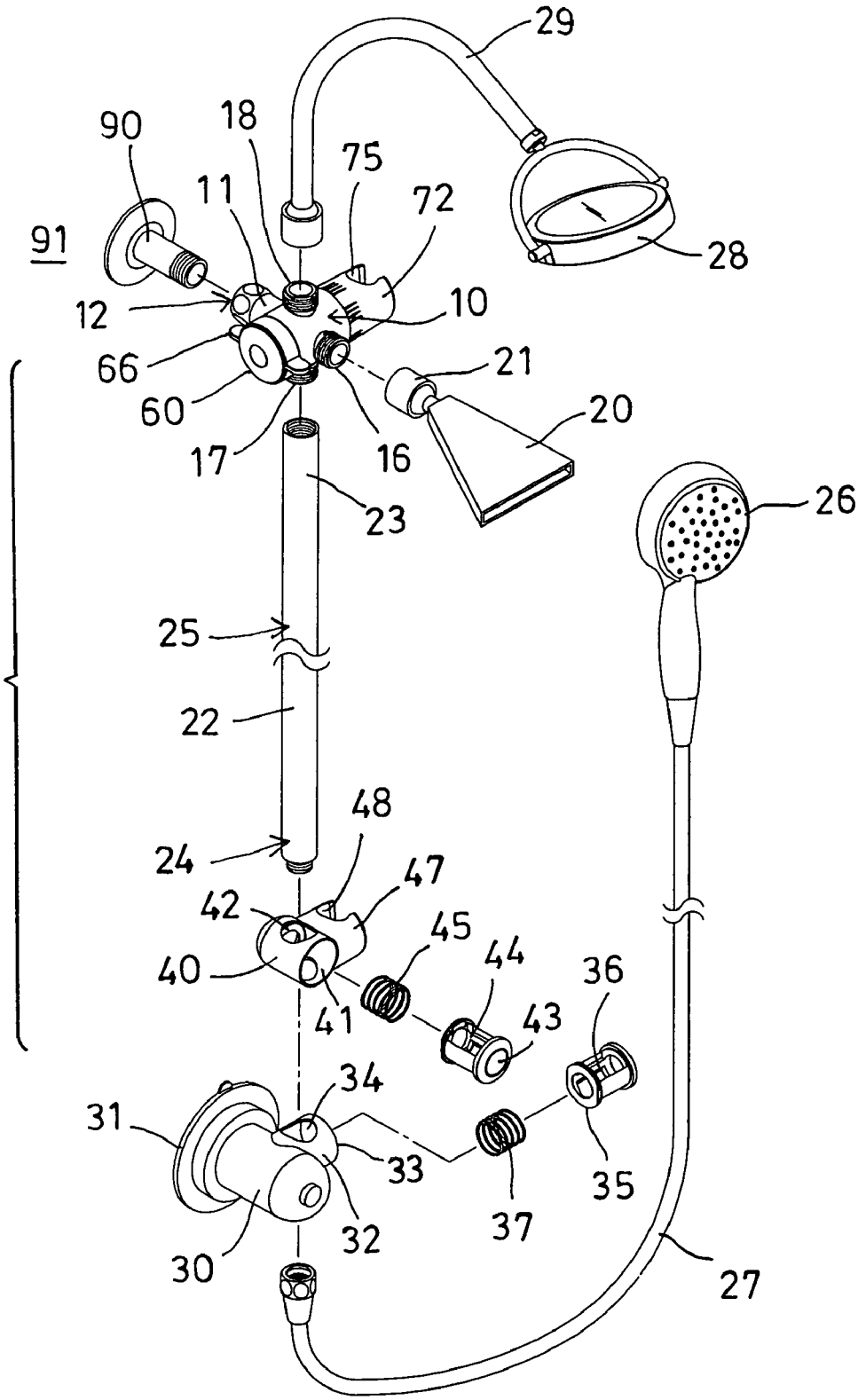
FIG. 1 is an exploded view of a holder device in accordance with the present invention.

Referring to the drawings, and initially to FIGS. 1-4, a holder device 1 in accordance with the present invention comprises a holder body or primary housing 10 including an inlet 11 for attaching or securing to a water outlet tube 90 with one or more fasteners 12 and gaskets 13 or the like, and the water outlet tube 90 is normally or typically attached onto or extended from a wall or a supporting surface 91, and coupled to the typical or conventional water reservoirs for receiving water from the water reservoirs, and thus for supplying the water to the housing 10. A control device (not shown) may typically be provided and attached onto the wall or the supporting surface 91, and disposed below the water outlet tube 90, for controlling hot water and/or cold water to flow out through the water outlet tube 90. The above-described water outlet tube 90 and the control device for attaching and controlling the holder device 1 are typical and will not be described in further details.

The housing 10 includes a casing 14 disposed therein and having a chamber 15 formed or provided therein and communicating with the inlet 11 thereof, for receiving the water from the water reservoirs, and further includes two or more outlet ports 16, 17, 18 communicating with the chamber 15 of the casing 14, for allowing the water to flow out through either or both of the two outlet ports 16, 17, 18 of the housing 10 (FIGS. 4-10), and to be controlled to selectively flow out through either of the outlet ports 16, 17, 18 of the housing 10.

A sprayer device or shower head 20 may further be provided and attached or secured to one of the outlet ports 16, 17, 18, such as the outlet port 16 of the housing 10 with one or more fasteners and/or gaskets 21 or the like, for allowing the water to selectively flow out through the typical or conventional shower head 20 via the outlet port 16 of the housing 10. A pipe 22 includes an upper portion 23 secured or attached or coupled to the other outlet port 17 of the housing 10 for receiving the water from the housing 10, and includes a lower portion 24 and an intermediate portion 25, and the lower portion 24 of the pipe 22 may be coupled or secured to a sprayer nozzle 26 with a hose 27 (FIGS. 1, 2), for example, for allowing the water to selectively flow out of the other outlet port 17 of the housing 10 and then to flow out through the sprayer nozzle 26. Another sprayer nozzle or sprayer device 28 may be coupled or secured to the further outlet port 18 of the housing 10 with a tubular member 29 for receiving the water from the housing 10 and for allowing the water to selectively flow out of the sprayer device 28.

A base 30 includes a cup 31 attached thereto for attaching or securing to supporting surfaces 91 or walls or the like with suction forces or with adhesive materials, without fasteners, and includes a conduit 32 laterally extended therefrom and having a bore 33 formed therein, and an orifice 34 formed through the conduit 32 and intersecting or communicating with and/or perpendicular to the bore 33 of the conduit 32, for slidably receiving the lower portion 24 of the pipe 22. A latch 35 is slidably received in the bore 33 of the conduit 32, and includes an opening 36 formed therein for slidably receiving the lower portion 24 of the pipe 22, and a spring member 37 is also received in the bore 33 of the conduit 32, and engaged with the latch 35, for forcing or biasing the latch 35 toward or against the lower portion 24 of the pipe 22, and for adjustably clamping or securing or coupling the lower portion 24 of the pipe 22 to the base 30.

It is preferable that the latch 35 includes a serrated surface or one or more teeth or projections formed therein (not shown), for frictionally engaging with the pipe 22, and for solidly securing the pipe 22 to the base 30. It is to be noted that the lower portion 24 of the pipe 22 may be coupled to or attached to or positioned to the supporting surfaces 91 with the base 30, and the upper portion 23 of the pipe 22 may be solidly secured or attached to the other outlet port 17 of the housing 10 such that the weight of the pipe 22 and the base 30 may be supported or sustained by the other outlet port 17 of the housing 10 and will not be applied onto the base 30, and such that the cup 31 of the base 30 may be used to stably attach or couple or position the pipe 22 and the base 30 to the supporting surfaces 91.

A seat 40 includes a bore 41 formed therein, and an aperture 42 formed through the seat 40 and intersecting or communicating with and/or perpendicular to the bore 41 of the seat 40, for slidably receiving an intermediate portion 25 of the pipe 22. A catch 43 is slidably received in the bore 41 of the seat 40, and includes an opening 44 formed therein for slidably receiving the intermediate portion 25 of the pipe 22. A spring member 45 is also received in the bore 41 of the seat 40, and engaged with the catch 43, for biasing the catch 43 against the intermediate portion 25 of the pipe 22, and for adjustably clamping or securing or coupling the intermediate portion 25 of the pipe 22 to the seat 40. It is also preferable that the catch 43 includes a serrated surface or one or more teeth or projections formed therein (not shown), for frictionally engaging with the pipe 22, and for stably and solidly securing the pipe 22 to the seat 40.

Figure 2:
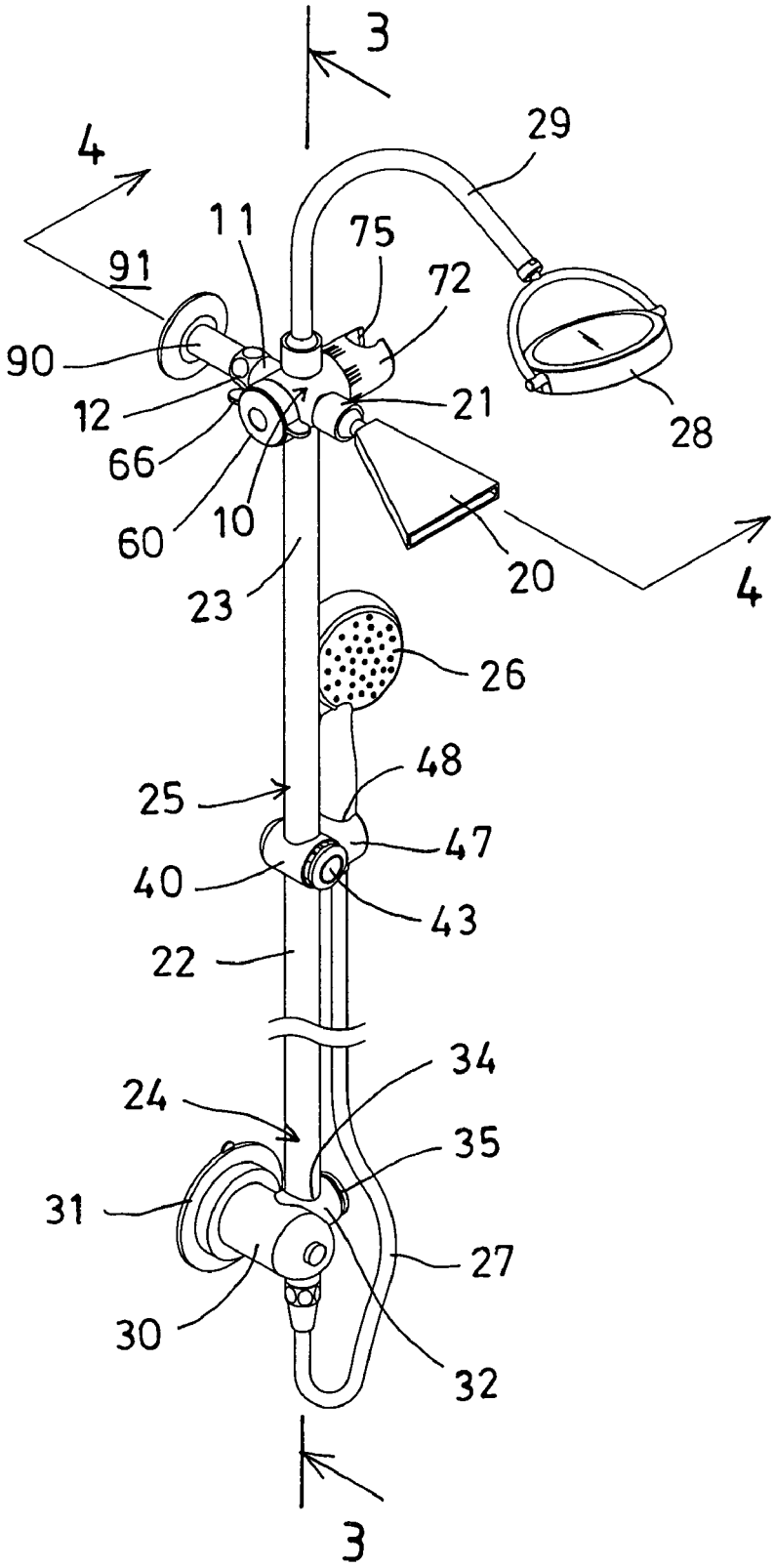
FIG. 2 is a perspective view of the holder device.

The seat 40 includes a bracket 47 attached thereto or extended therefrom and having a key hole or engaging hole 48 formed therein for removeably or selectively supporting the shower nozzle 26 (FIG. 2). It is to be noted that the seat 40 may be easily adjusted along the pipe 22 to various or selected positions by depressing the catch 43 against the spring member 45 and by loosely receiving the intermediate portion 25 of the pipe 22 in the aperture 42 of the seat 40, in order to support the shower nozzle 26 at different or various or selected positions of the pipe 22, to allow the shower nozzle 26 to be easily fetched or obtained or used by adults, children or various people of different sizes or heights. It is to be noted that the sprayer nozzle 26 may be easily and readily attached to the bracket 47 of the seat 40 which is adjustably attached to the pipe 22, and the housing 10 is directly attached to the water outlet tube 90, such that no holes are required to be drilled within the wall or the supporting surface 91, and thus no wall mounted brackets are required to be attached or secured to the supporting surfaces 91 or walls or the like.

The holder device 1 further includes a valve stem 50 rotatably attached or received within the chamber 15 of the casing 14, or directly attached or received within the housing 10, and one or more sealing rings 51 attached or engaged onto the valve stem 50 and engaged with the casing 14 or the housing 10, and thus for making a water tight seal between the valve stem 50 and the casing 14 or the housing 10. The valve stem 50 includes a passage 52 and a bore 55 formed therein (FIGS.

8, 9, 10) for communicating the inlet 11 of the housing 10 with either or all of the outlet ports 16, 17, 18 of the housing 10, to allow the water to selectively flow out through either or both of the two outlet ports 16, 17, 18 of the housing 10. The valve stem 50 includes a compartment 53 formed therein, for receiving a valve member 54 which may engage with either of the valve seats 56 (FIGS. 4-6, 9-10) that are formed in the casing 14 or the housing 10, and that are communicating with the outlet ports 16, 17, 18 of the housing 10 respectively.

Figure 4:
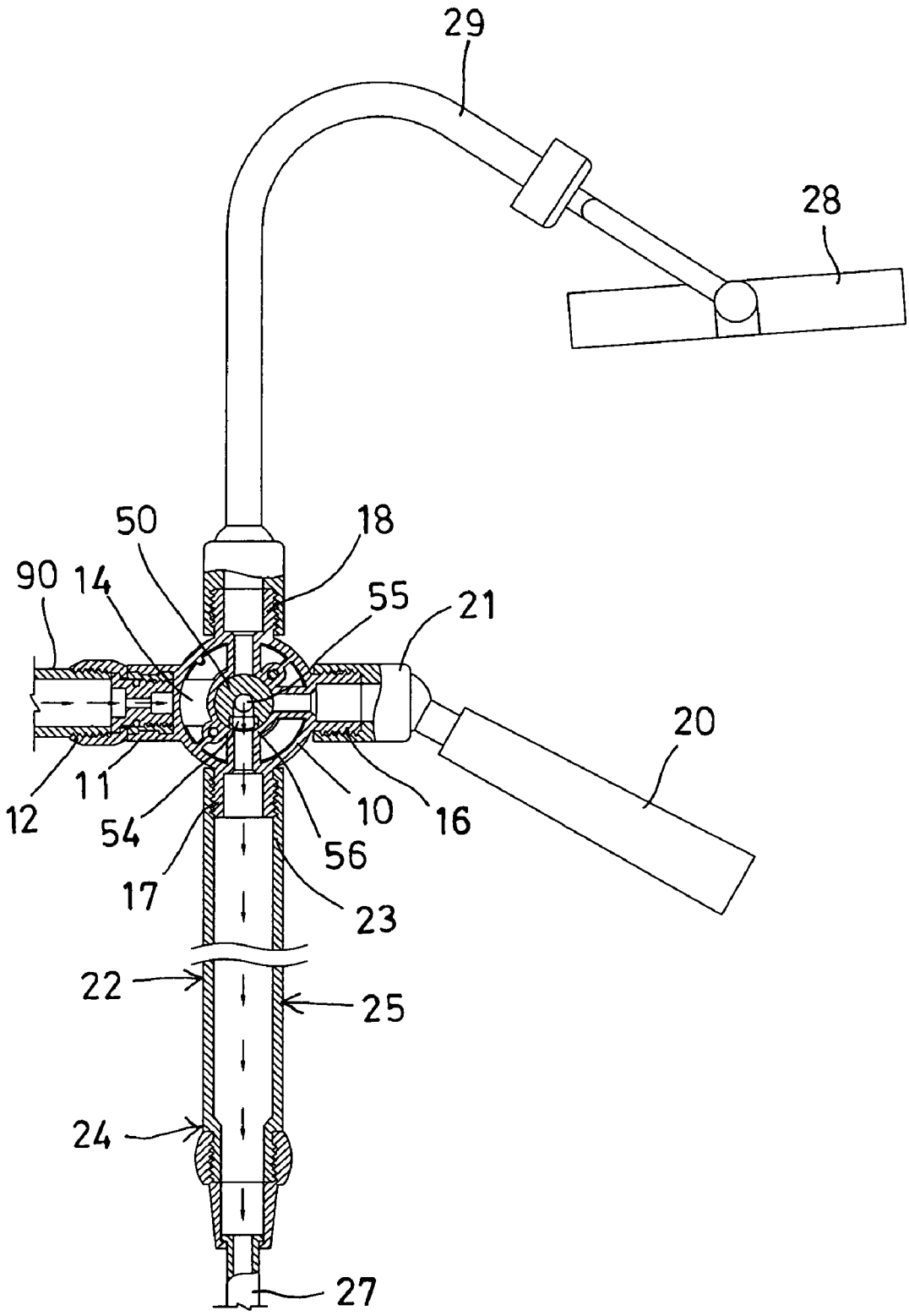
FIG. 4 is a partial cross sectional view of the holder device, taken along lines 4-4 of FIG. 2.
Figure 5:
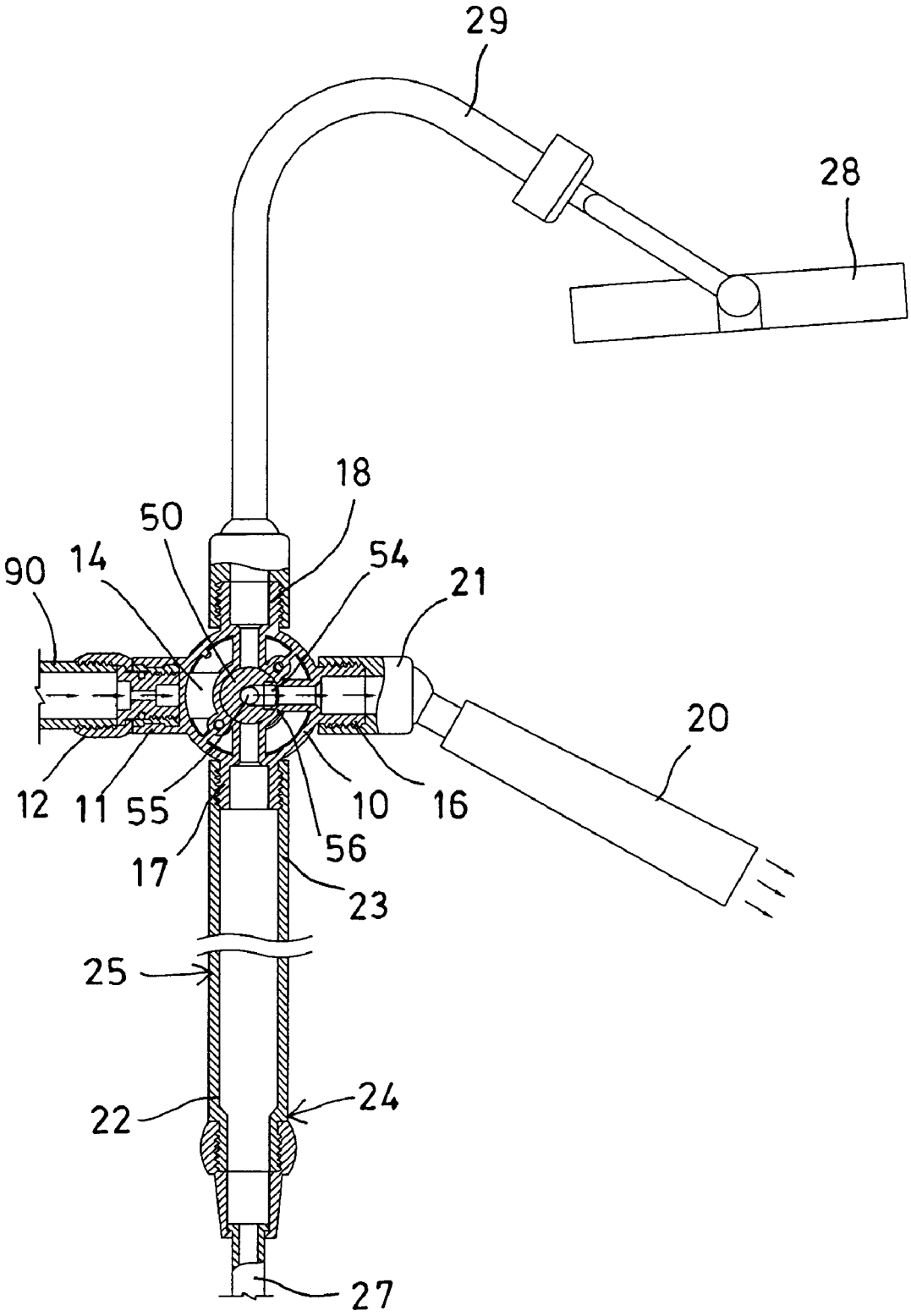
FIGS. 5, 6 are partial cross sectional views similar to FIG. 4, illustrating the operation of the holder device.
Figure 6:
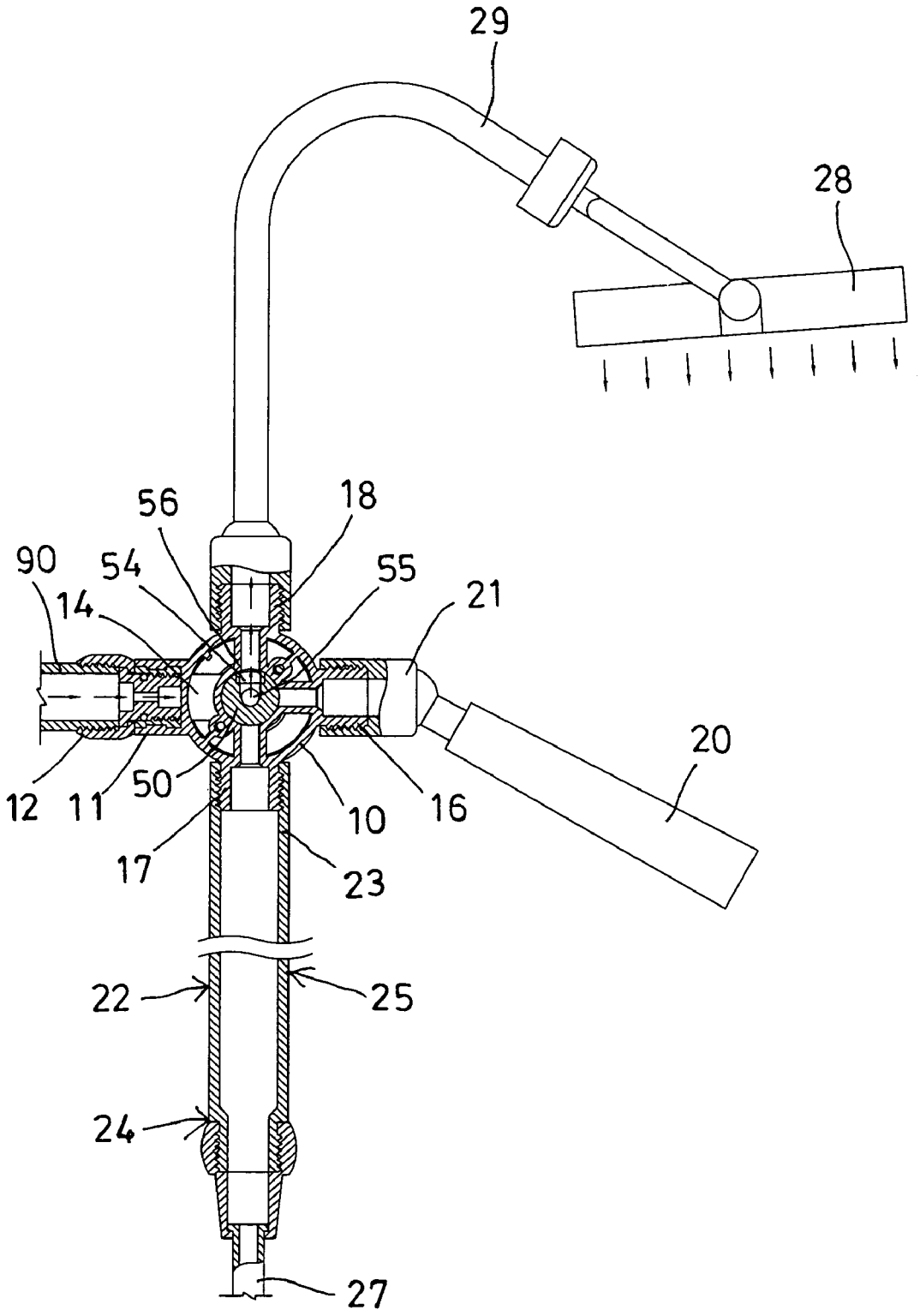
Figure 7:
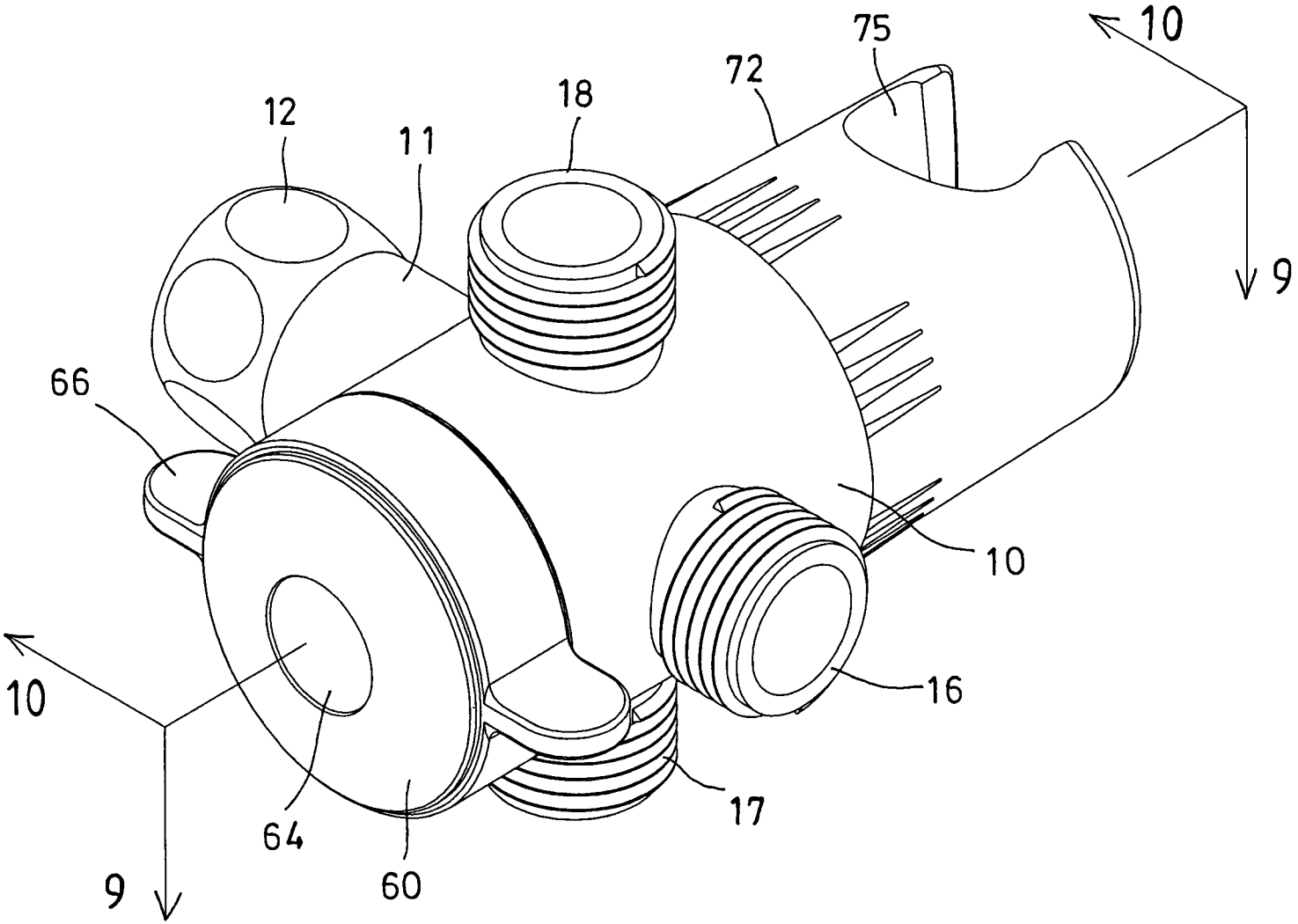
FIG. 7 is a perspective view illustrating a holder body or primary housing of the holder device.
Figure 8:
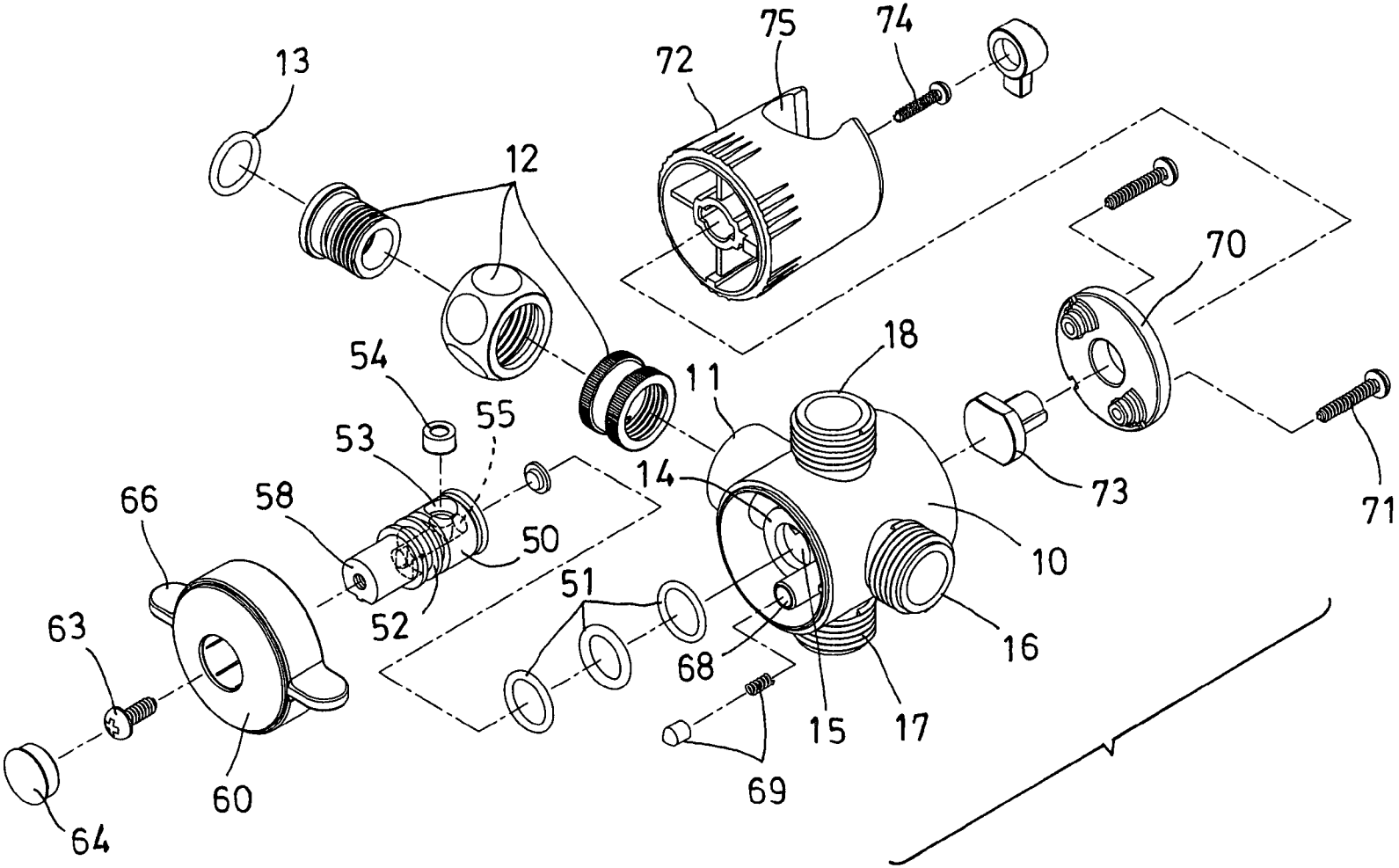
FIG. 8 is an exploded view of the holder body or primary housing of the holder device.

For example, as shown in FIGS. 4-6, the valve stem 50 may be rotated relative to the housing 10 in order to align the valve member 54 with either of the valve seats 56 of the casing 14 or the housing 10 to allow the water to flow out through either the shower head 20 that is attached to the outlet port 16 of the housing 10 (FIG. 5), or the hose 27 and the sprayer nozzle 26 that is attached to the other outlet port 17 of the housing 10 (FIG. 4), or the tubular member 29 and the sprayer-device 28 that is attached to the further outlet port 18 of the housing 10 (FIG. 6). The valve stem 50 includes one end portion 58 (FIG. 8) for attaching or securing to a handgrip or knob 60 which may be used to rotate or to operate the valve stem 50 relative to the casing 14 or the housing 10. The valve stem 50 may thus be used and acted as a controlling means or device for controlling the water to flow out through either of the shower head 20, the sprayer nozzle 26 or the sprayer device 28.

Figure 3:
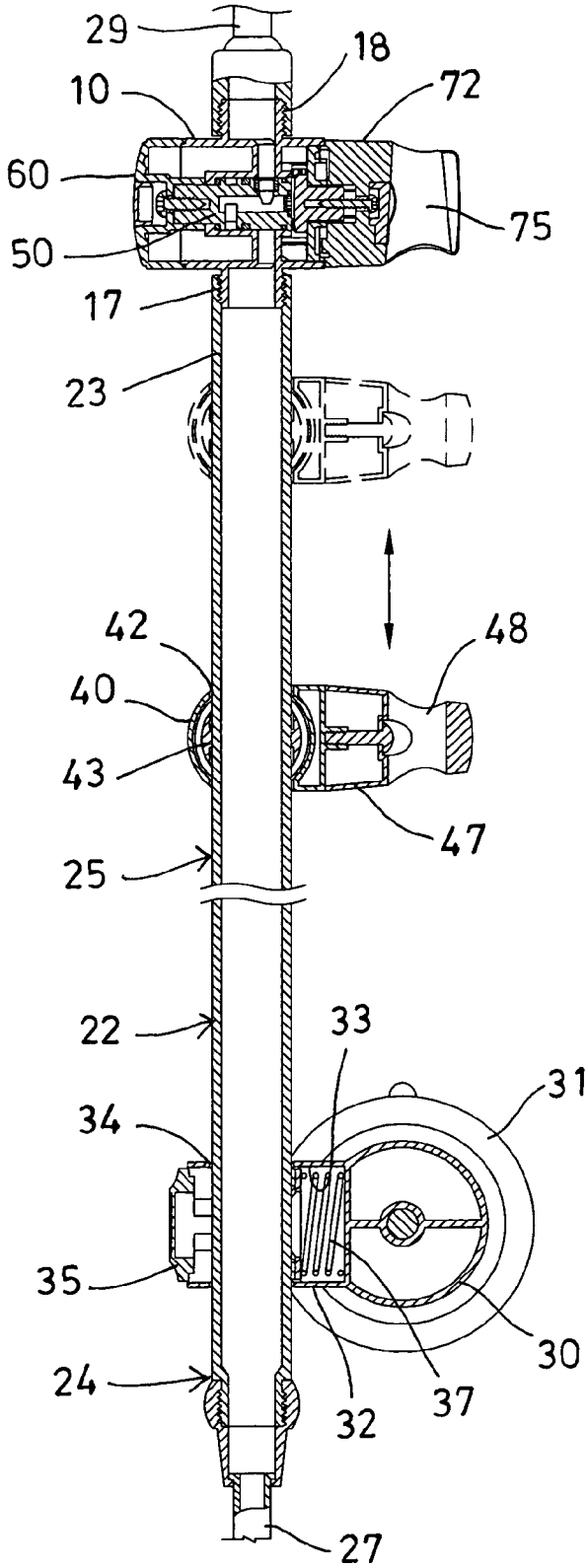
FIG. 3 is a partial cross sectional view of the holder device, taken along lines 3-3 of FIG. 2.
Figure 9:
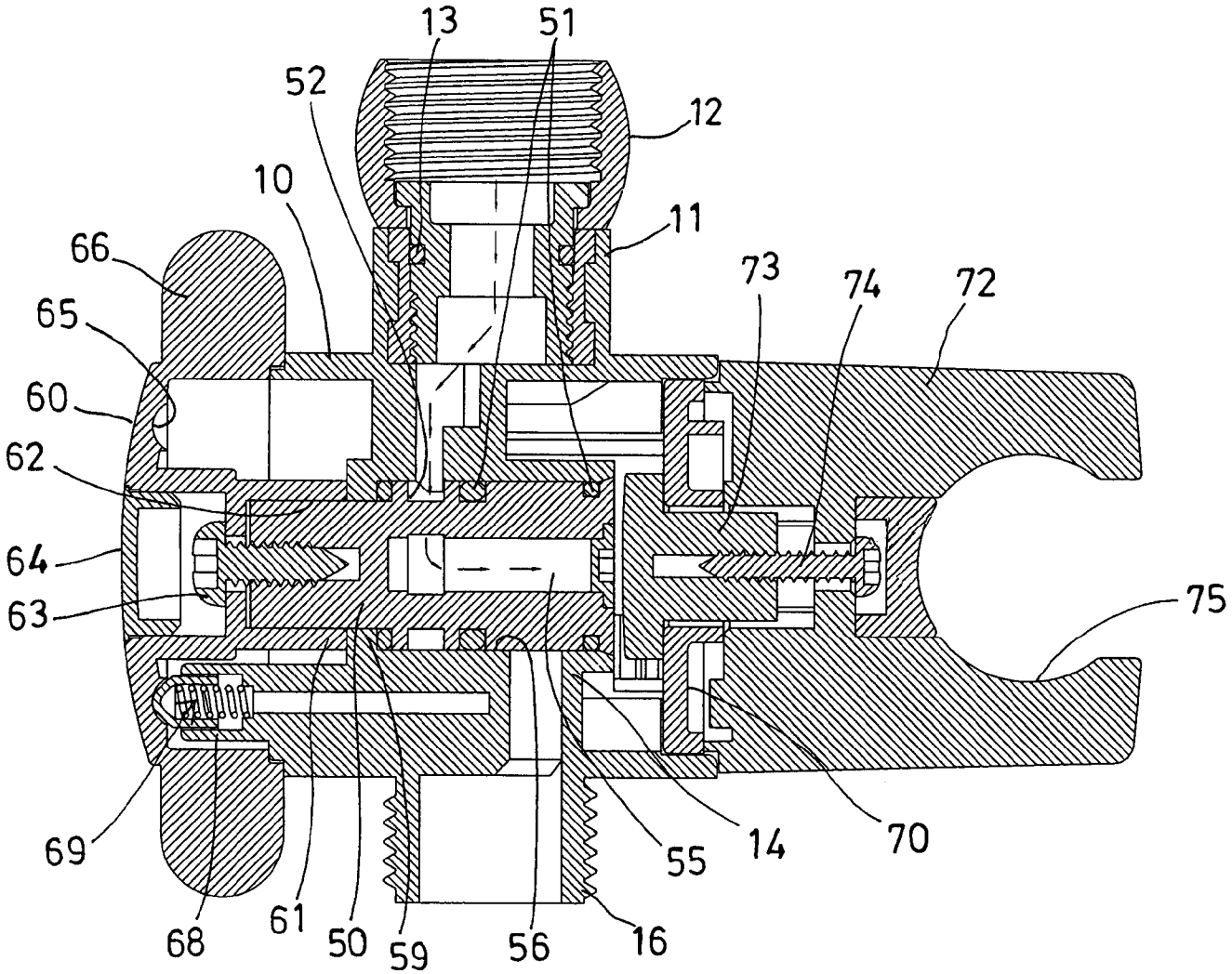
FIGS. 9, 10 are cross sectional views of the holder device, taken along lines 9-9, and 10-10 of FIG. 7 respectively.
Figure 10:
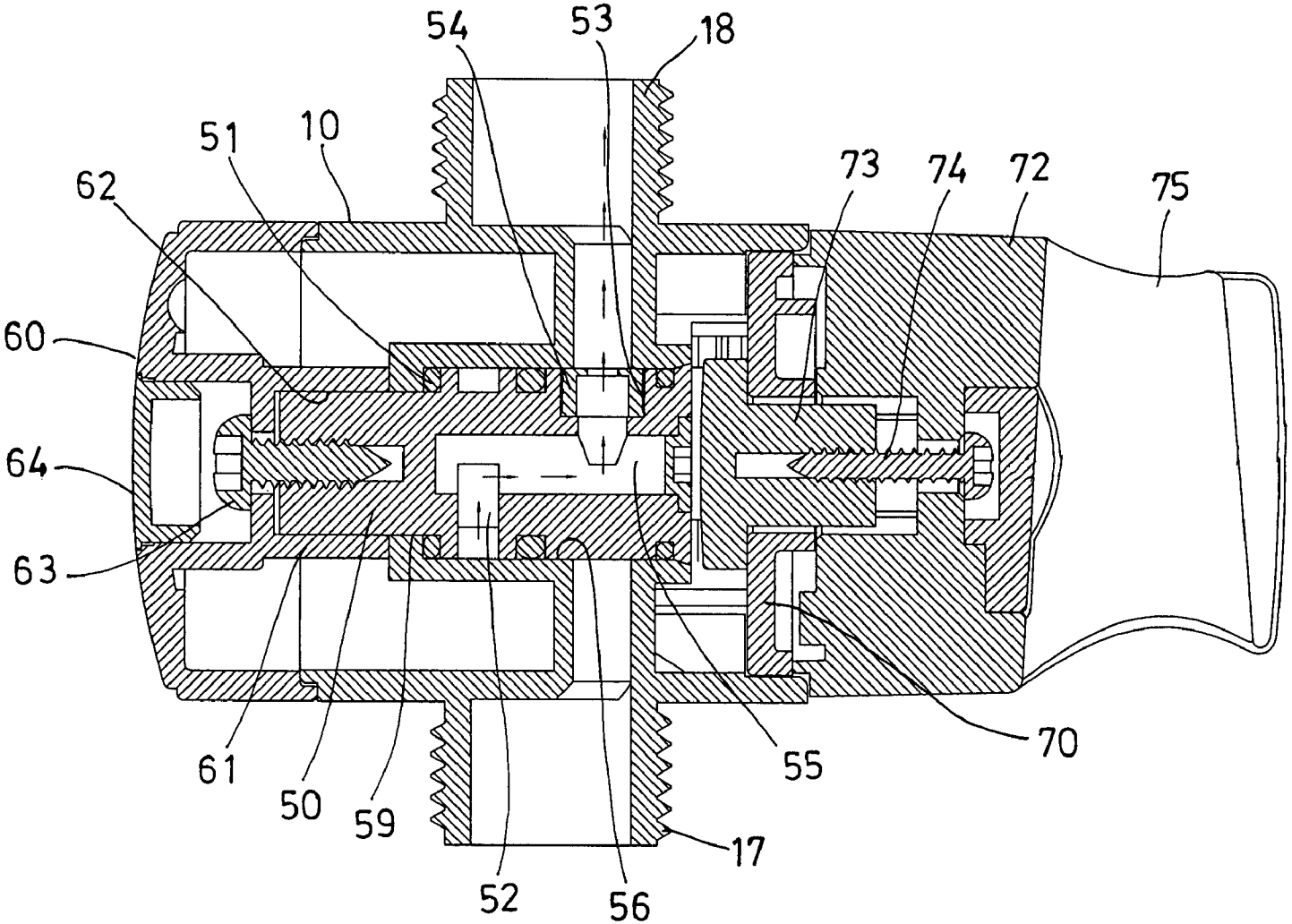

As shown in FIG. 3, the housing 10 may further include a peripheral stop 59 extended therein, such as extended into the chamber 15 of the casing 14 (FIGS. 9, 10) for engaging with the valve stem 50, and for rotatably anchoring the valve stem 50 to the casing 14 or the housing 10, and thus for preventing the valve stem 50 from sliding laterally or longitudinally relative to the casing 14 or the housing 10. As also shown in FIGS. 9 and 10, the knob 60 includes a barrel 61 extended therefrom and having a cavity 62 formed therein, for receiving the end portion 58 of the valve stem 50, which may further be solidly secured to the knob 60 with one or more fasteners 63, to solidly secure the valve stem 50 to the knob 60. It is preferable that the cavity 62 of the barrel 61 and the end portion 58 of the valve stem 50 each includes a non-circular cross section, to prevent the valve stem 50 from being rotated relative to the knob 60. The knob 60 may further include a lid 64 provided and attached to the knob 60 for covering, shielding and protecting the fasteners 63 and for preventing the fasteners 63 from being wetted or rusted. The knob 60 may further include one or more, such as three depressions 65 formed therein, and includes one or more flaps 66 extended outwardly therefrom, for allowing the knob 60 and thus of the valve stem 50 to be easily rotated relative to the casing 14 or the housing 10 with the knob 60.

The casing 14 or the housing 10 may further include a stud 68 extended therefrom, such as extended toward the knob 60, for receiving a spring-biased projection 69 therein, in which the spring-biased projection 69 may engage into either of the depressions 65 of the knob 60, to anchor or to position the knob 60 to the casing 14 or to the housing 10 at selected angular positions. For example, when the spring-biased projection 69 is biased to engage into one of the depressions 65 of the knob 60, the valve member 54 may be positioned and maintained in engagement with either of the valve seats 56 (FIGS. 4-6) for guiding or controlling the water to flow out through the shower head 20, the sprayer nozzle 26, or the sprayer device 28.

Figure 11:
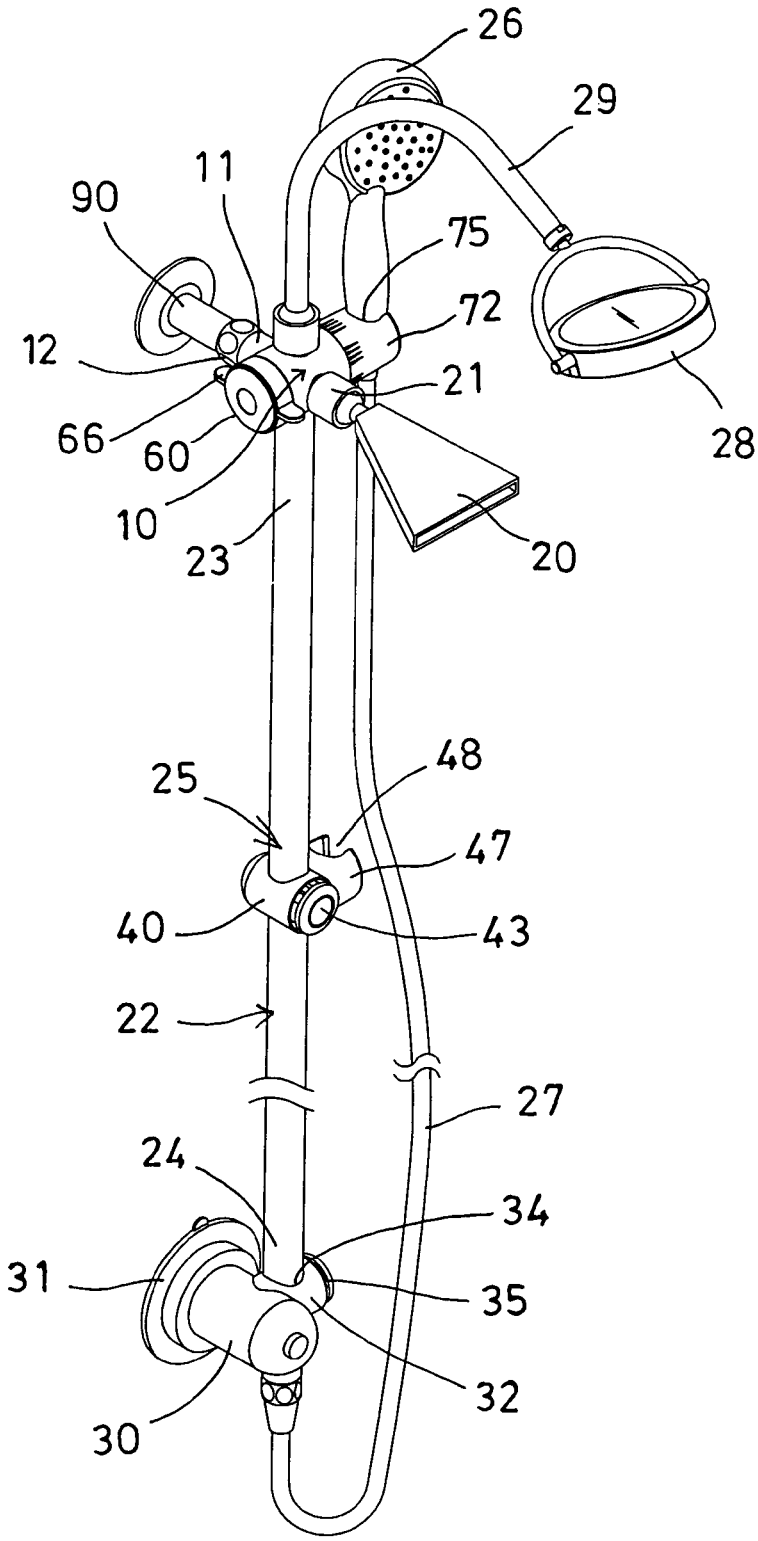
FIG. 11 is a perspective view similar to FIG. 2, illustrating the operation of the holder device.

A plate 70 may be attached or secured to the housing 10 with one or more fasteners 71 to close or to shield the housing 10 and to protect the valve stem 50 and to stably retain the valve stem 50 in the housing 10. Another bracket 72 may further be provided and attached or secured to the housing 10 or the plate 70 with an insert 73 and one or more fasteners 74, and may include a key hole or engaging hole 75 formed therein for removeably or selectively supporting the shower nozzle 26 (FIG. 11) to allow the shower nozzle 26 to be selectively and highly supported on the upper portion 23 of the pipe 22 and to prevent the shower nozzle 26 from being easily fetched or obtained or used by children or the like.

In operation, as shown in FIGS. 4-6, the valve stem 50 may be easily rotated relative to the casing 14 or the housing 10 with the knob 60, in order to control the water to flow out through either of the shower head 20, the sprayer nozzle 26 or the sprayer device 28 via either of the outlet ports 16, 17, 18 of the housing 10. In addition, the shower head 20 and the sprayer nozzle 26 and the sprayer device 28 may be attached to the housing 10 that may be directly attached or secured to the water outlet tube 90, without drilling holes in the wall or the supporting surface 91. The seat 40 may be moved up and down or adjusted along the pipe 22 to various or selected positions for adjustably supporting the sprayer nozzle 26 to the intermediate portion 25 of the pipe 22. It is to be noted that no holes are required to be drilled into the supporting surfaces or walls 91 or the like, such that the holder device 1 may be easily attached onto the supporting surfaces or walls 91 or the like, and assembled or mounted by the users themselves.

Accordingly, the holder device in accordance with the present invention may be directly attached to the water outlet tube that is typically provided and extended from the supporting surfaces or walls, for supporting shower heads and/or shower nozzles and the like, without drilling holes in the supporting surfaces or walls or the like, and for controlling the water to flow out through either or both of the shower heads and the nozzles.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A holder device for attaching to a water outlet tube which is extended from a supporting surface, said holder device comprising:

a housing including an inlet for attaching to the water outlet tube and for receiving a water from the water outlet tube, said housing including a first outlet port and a second outlet port and a third outlet port, and including a casing received in said housing, said casing including a chamber formed therein and communicating with said inlet and said first outlet port and said second outlet port and said third outlet port of said housing, said housing including three valve seats formed in said casing and communicating with said first outlet port and said second outlet port and said third outlet port of said housing respectively, a pipe including an upper portion coupled to said first outlet port of said housing for receiving the water from said housing, and including a lower portion and an intermediate portion, a sprayer nozzle coupled to said lower portion of said pipe for receiving the water from said pipe, a first sprayer device attached to said second outlet port of said housing, a second sprayer device attached to said third outlet port of said housing, a base including a conduit extended therefrom and having a bore formed in said conduit, and an orifice formed through said conduit and communicating with said bore of said conduit for slidably receiving said pipe, a spring-biased latch slidably received in said bore of said conduit and having an opening formed in said latch for slidably receiving said pipe, a seat slidably attached onto said pipe and including a bracket extended from said seat and having an engaging hole formed in said bracket for removeably supporting said sprayer nozzle, said seat including a bore formed therein, and an aperture formed through said seat and communicating with said bore of said seat for slidably receiving said intermediate portion of said pipe, a spring-biased catch slidably received in said bore of said seat and having an opening formed in said catch for slidably receiving said intermediate portion of said pipe and for biasing said catch to said pipe and for adjustably securing said seat to said pipe, a valve stem rotatably attached in said chamber of said casing, and having a passage formed in said valve stem for communicating said inlet of said housing with said first outlet port and said second outlet port and said third outlet port of said housing, to allow the water to selectively flow out through said first outlet port and said second outlet port and said third outlet port of said housing, said valve stem including a compartment formed therein, a valve member received in said compartment of said valve stem to engage with either of said valve seats of said housing, and to control the water to flow out through said first outlet port and said second outlet port and said third outlet port of said housing, and a knob secured to said valve stem to rotate said valve stem relative to said casing and said housing.

2. The holder device as claimed in claim 1, wherein said housing includes a spring-biased projection disposed therein and engageable with said knob to position said knob to said housing at selected positions.

3. The holder device as claimed in claim 1, wherein said knob includes a barrel extended therefrom, and at least one flap extended outwardly from said knob for allowing said valve stem to be easily rotated relative to said housing with said knob.

4. The holder device as claimed in claim 1, wherein a second bracket is attached to said housing and includes an engaging hole formed in said second bracket for removeably supporting said sprayer nozzle.

5. The holder device as claimed in claim 4, wherein said second bracket is attached to said housing with a plate, an insert and a fastener.

6. The holder device as claimed in claim 1, wherein said first sprayer device is a shower head.

* * * * *